US006418286B1

(12) United States Patent
Hou

(10) Patent No.: US 6,418,286 B1
(45) Date of Patent: Jul. 9, 2002

(54) ELECTROSTATOGRAPHIC REPRODUCTION MACHINE HAVING A BELT CONICITY REDUCING ASSEMBLY

(75) Inventor: James S. Hou, Cheshire, CT (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/708,098

(22) Filed: Nov. 6, 2000

(51) Int. Cl.[7] ..... G03G 15/00
(52) U.S. Cl. ..... 399/165
(58) Field of Search ..... 399/165, 162, 399/303, 312, 313, 329; 198/806, 807; 474/122, 123, 124, 134, 135

(56) References Cited

U.S. PATENT DOCUMENTS 4,998,145 A 3/1991 Haneda et al.
5,270,769 A 12/1993 Satoh et al.
5,313,259 A 5/1994 Smith

*Primary Examiner*—Robert Beatty
(74) *Attorney, Agent, or Firm*—Tallam I. Ngutt

(57) ABSTRACT

An electrostatographic reproduction machine including a media assembly for supplying and moving toner image receiving media passed a toner image transfer device; a fusing apparatus for heating and fusing a toner image on the toner image receiving media; and an imaging assembly for forming and transferring a toner image onto the toner image receiving media. The imaging assembly includes an endless photoreceptor belt having an imageable surface for forming the toner image, and a conicity reducing belt support and moving subassembly for supporting and moving the endless photoreceptor belt. The conicity reducing belt support and moving subassembly includes (i) a moveable steering roll for moving in a first direction into the endless photoreceptor belt and in a second direction along an inner surface of the endless photoreceptor belt, and (ii) a moveable tensioning roll for moving in a third direction into the endless photoreceptor belt and in a fourth direction along the inner surface of the endless photoreceptor belt, thereby reducing belt conicity and belt wrinkle, and increasing belt lateral registration.

7 Claims, 2 Drawing Sheets

ELECTROSTATOGRAPHIC REPRODUCTION MACHINE HAVING A BELT CONICITY REDUCING ASSEMBLY

BACKGROUND OF THE INVENTION

This invention relates to a electrostatographic reproduction machine architecture, and more particularly, such a machine having a photoreceptor belt conicity reducing support assembly.

A typical electrophotographic or electrostatographic reproduction machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrostatographic reproduction machine of this type to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image.

The resultant multi-color powder image is subsequently transferred to a sheet. The transferred multi-color image is then permanently fused to the sheet forming the color print. Hereinbefore, a color electrostatographic reproduction machine used four developer units. These developer units were all disposed on one side of the photoconductive belt with the other side thereof being devoid of developer units. A color electrostatographic reproduction machine of this type required an overly long photoconductive belt. A photoconductive belt of this type would require eleven, nine-inch pitches to operate at 100 ppm. A belt of this length will have very low yields when being made in large quantities. In addition, this results in an overly tall electrostatographic reproduction machine when the photoconductive belt is arranged with the major axis aligned vertically. The requirement of having all of the developer units or exposure stations on one side of the photoconductive belt is necessary in order to maintain image-on-image registration. Thus, it is highly desirable to reduce the overall height of the electrostatographic reproduction machine while still maintaining the required image-on-image registration.

Various different architectures for multi-color electrostatographic reproduction machines have heretofore been employed. For example, U.S. Pat. No. 4,998,145 discloses an electrophotographic electrostatographic reproduction machine having a plurality of developer units adjacent one another on one side of the diameter of a photoconductive drum.

U.S. Pat. No. 5,270,769 describes a electrostatographic reproduction machine having a plurality of developer units disposed on one side of a photoconductive belt. A cleaning unit is positioned on the other side of the photoconductive belt. Different colored developed images are transferred to an intermediate belt. The resultant composite multi-color image is then transferred from the intermediate belt to a sheet of support material and fused thereto. The photoconductive belt is arranged vertically.

U.S. Pat. No. 5,313,259 discloses a multi-color electrophotographic electrostatographic reproduction machine in which an endless photoconductive belt is vertically oriented. The machine includes four groups of stations for printing in cyan, magenta, yellow, and black. Each station includes a charged corona generator, a raster output scanning laser assembly, and a developer unit. These stations are positioned on one side of the photoconductive belt with the fourth station being disposed on the other side thereof. Successive different color toner particle images are formed in superimposed registration with one another on the photoconductive belt and transferred to a copy sheet simultaneously. Transfer occurs at the lowermost position of the photoconductive belt.

Typically, in these conventional machine architectures, the endless photoconductive belt is arranged into two sides or spans (a slack span and a tension span) that are supported vertically, about a drive roll, skid backer bars, a stripper roll, and a steering and tensioning roll. As such the belt has, and is moved in, a generally elliptical configuration that includes a single free major axis.

Unfortunately, when there are many skid backer bars on both the slack side and the tension side of the configuration, the single free major axis of belt movement becomes less responsive to belt conicity. As an undesirable consequence, belt conicity compensation of the architecture is compromised. In addition, when the drive roll pushes the belt towards its slack span, drag on the many skid backer bars produces a stiff tension drive between spans, resulting in belt undesirable shear and belt wrinkle.

SUMMARY OF THE INVENTION

In accordance with one aspect of the present invention, there is provided an electrostatographic reproduction machine including a media assembly for supplying and moving toner image receiving media passed a toner image transfer device; a fusing apparatus for heating and fusing a toner image on the toner image receiving media; and an imaging assembly for forming and transferring a toner image onto the toner image receiving media. The imaging assembly includes an endless photoreceptor belt having an imageable surface for forming the toner image, and a conicity reducing belt support and moving subassembly for supporting and moving the endless photoreceptor belt. The conicity reducing belt support and moving subassembly includes (i) a moveable steering roll for moving in a first direction into the endless photoreceptor belt and in a second direction along an inner surface of the endless photoreceptor belt, and (ii) a moveable tensioning roll for moving in a third direction into the endless photoreceptor belt and in a fourth direction along the inner surface of the endless photoreceptor belt, thereby reducing belt conicity and belt wrinkle, and increasing belt lateral registration.

BRIEF DESCRIPTION OF THE DRAWINGS

Other aspects of the present invention will become apparent as the following description proceeds and upon reference to the drawing, which is.

DETAILED DESCRIPTION OF THE INVENTION

Figure 1:
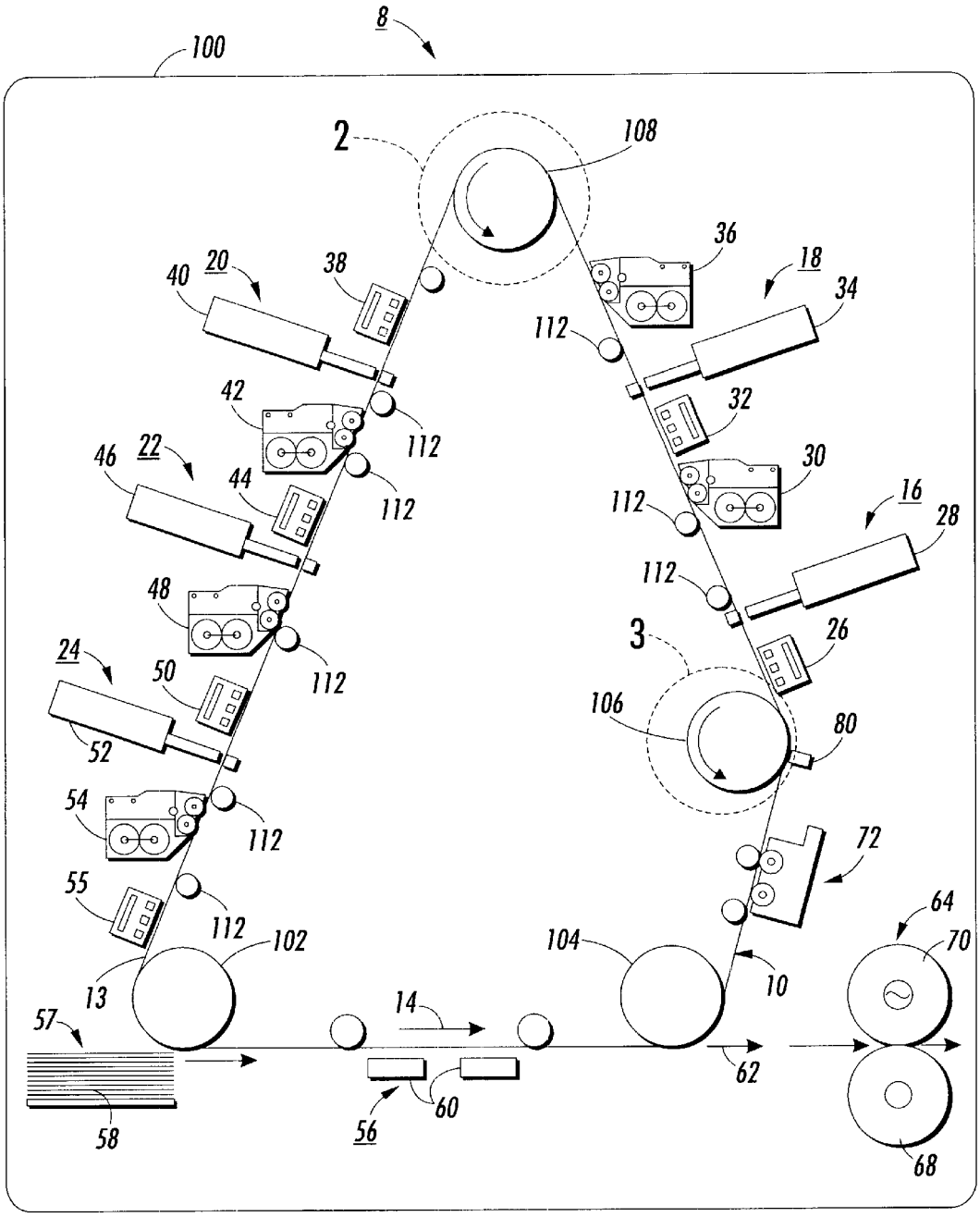
FIG. 1 is a vertical schematic of an exemplary electrostatographic reproduction machine including the belt conicity reducing support assembly of the present invention.
Figure 2:
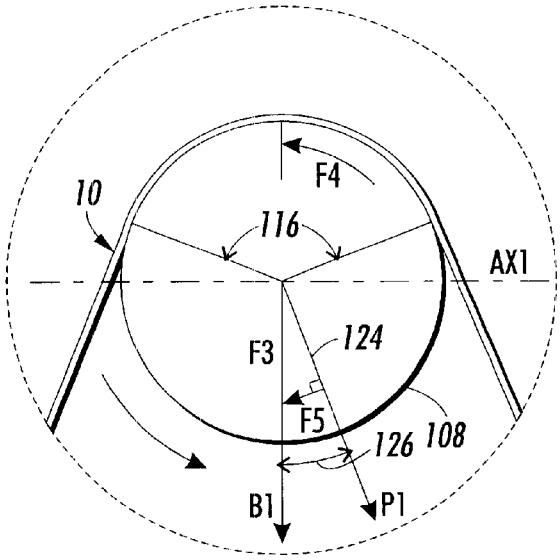
FIG. 2 is an enlarged schematic illustration of the steering roll movement and forces relative to photoreceptor belt in accordance with the present invention.
Figure 3:
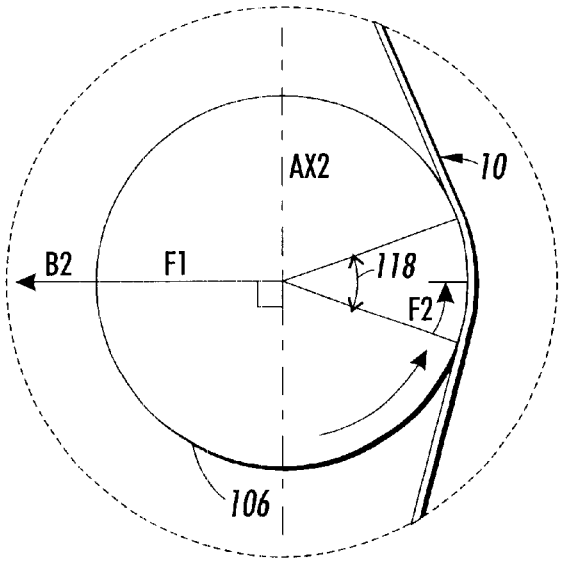
FIG. 3 is an enlarged schematic illustration of the steering roll movement and forces relative to photoreceptor belt in accordance with the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Referring now to the drawing, there is shown the electrostatographic reproduction machine of the present invention is illustrated as a single pass multi-color electrostatographic reproduction machine 8. As shown, the machine 8 includes a frame 9, a media assembly 57 mounted to the frame 9 for supplying and feeding toner image carrying media such as copy sheets 58 through an image transfer station 56, and a fusing apparatus 64 that includes a pressure roll 68 and a heated fuser roll 70 for heating a fusing toner images to recording media 58.

As further shown, the machine 8 employs an endless image bearing member or photoconductive belt 10 that has an imageable surface 13 for forming toner images thereon. A series of imaging devices as shown (to be described below) are located in image forming relationship with the imageable surface 13 for forming toner images on the surface 13.

The machine 8 importantly includes a belt conicity reducing assembly in the form of a belt moving and support assembly 100 for supporting and moving the photoconductive belt 10 so as to reduce its conicity, and thus improve belt lateral registration. As illustrated, the belt conicity reducing assembly or belt moving and support assembly 100 comprises four (4) dominant rolls that include a drive roll 102, a sheet stripper roll 104, a moveable tensioning roll 106, and a moveable steering roll 108 of a steering assembly 110. The belt moving and support assembly 100 also includes a series of skid backer bars 112, as shown.

The assembly 100 includes two degrees of freedom a first of which is provided by the moveable steering roll 108 which includes a first free hard axis AX1 that allows the steering roll 108 to not only be moved by a tensioning force applied thereto in a first direction B1 into the belt 10, but to also pivot and thus move in a second direction AX1 along the inner surface of the belt 10. The second degree of freedom is provided by the tensioning roll 106 which has a second free hard axis AX2 that allows the tensioning roll 106 to not only be moved by a tensioning force applied thereto in a third direction B2 into the belt 10, but to also be translated and thus moved in a fourth direction AX2 along the inner surface of the belt 10.

The steering roll 108 and the tensioning roll 106 are located strategically within the loop 113 of the belt 10, and the wrap angles 116, 118 about the rolls 108, 106, respectively are determined so as to reduce risk of belt wrinkle and increase belt lateral registration and belt conicity compensation. Additionally, in order to reduce problems associated with belt conicity, belt wrinkle and lateral registration, the steering roll 108 and the tensioning roll 106 are mounted such that the first free hard axis AX1 is normal, or at 90 degrees, to a bisectrix B1 (coincident with the first direction) of the first wrap angle 116 of belt 10 about the steering roll 108, and also such that the second free hard axis AX2 is normal, or at 90 degrees, to a bisectrix B2 (coincident with the third direction) of the wrap angle 118 of belt 10 about the tensioning roll 106.

The tensioning roll 106 thus can be moved along its bisectrix B2 to exert a first belt tensioning force F1 against the belt 10, and also rotated about the axis AX2 to exert a second belt tensioning force F2 against the belt 10 for adjusting the conicity of the belt 10. On the other hand, the steering roll 108 can be moved along its bisectrix B1 to exert a third belt tensioning force F3 against the belt 10, and also rotated about the axis AX1 to exert a fourth belt tensioning force F4 against the belt 10 for adjusting the conicity of the belt 10.

The steering assembly 110 comprises the steering roll 108, a steering yoke member (not shown) and a camming subassembly (not shown), including pivot shaft 124, located at the ends of the yoke member. As mounted, the pivot shaft 124 defines, and is coincident with, a pivot axis P1 of the steering roll 108. As further shown, the pivot axis P1 forms a bias angle 126 with the bisectrix B1 of the wrap angle 116 of belt 10 about steering roll 108. As a consequence of the bias angle 126, the third belt tensioning force F3 exerted along the bisectrix B1 on the steering roll 108, will have a side force F5 that acts on the pivot shaft 124. This side force F5 biases the pivot shaft 124 and removes undesirable free play caused by clearance between the pivot shaft and its bearings (not shown).

As further shown, the tensioning roll 106 with its free hard axis AX2 is located between the stripper roll 104 and the steering roll 108 and sufficiently away from an imaginary straight line 130 between the centers of the steering and stripper rolls, but only to an extent that still creates a belt wrap angle 116 of greater than 90 degrees about the steering roll.

Referring again to the drawing, the belt 10 is arranged in a generally vertical orientation and is driven by drive roll 102 to advance in the direction of arrow 14. As advance, successive portions of its external and imageable surface 13 are moved sequentially beneath various processing stations formed by the various imaging devices (as shown) disposed about the path of movement thereof. The various processing stations include five image recording stations indicated generally by the reference numerals 16, 18, 20, 22, and 24, respectively.

Initially, belt 10 passes through image recording station 16. Image recording station 16 includes a charging device 26 and an exposure device 28. The charging device 26 is a corona generator that charges the exterior surface 13 of photoconductive belt 10 to a relatively high, substantially uniform potential. After the exterior surface of photoconductive belt 10 is charged, the charged portion thereof advances to the exposure device 28. The exposure device 28 for example is a raster output scanner (ROS), which illuminates the charged portion of the exterior surface of photoconductive belt 10 to record a first electrostatic latent image thereon. Alternatively, a light emitting diode (LED) may be used.

This first electrostatic latent image is developed by developer unit 30 which deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image is developed with toner particles by developer unit 36.

Developer unit 36 deposits toner particles (for example magenta color particles) on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 54, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the electrostatographic reproduction machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. The belt 10 then moves under spots blade 80 to also remove toner particles therefrom. It is, therefore, apparent that there has been provided in accordance with the present invention, an electrostatographic reproduction machine including a media assembly for supplying and moving toner image receiving media passed a toner image transfer device; a fusing apparatus for heating and fusing a toner image on the toner image receiving media; and an imaging assembly for forming and transferring a toner image onto the toner image receiving media. The imaging assembly includes an endless photoreceptor belt having an imageable surface for forming the toner image, and a conicity reducing belt support and moving subassembly for supporting and moving the endless photoreceptor belt. The conicity reducing belt support and moving subassembly includes (i) a moveable steering roll for moving in a first direction into the endless photoreceptor belt and in a second direction along an inner surface of the endless photoreceptor belt, and (ii) a moveable tensioning roll for moving in a third direction into the endless photoreceptor belt and in a fourth direction along the inner surface of the endless photoreceptor belt, thereby reducing belt conicity and belt wrinkle, and increasing belt lateral registration.

While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed:

1. An electrostatographic reproduction machine comprising (a) a media assembly for supplying and moving toner image receiving media passed a toner image transfer device;

(b) a fusing apparatus for heating and fusing a toner image on said toner image receiving media; and (c) an imaging assembly for forming and transferring a toner image onto said toner image receiving media, said imaging assembly including the toner image transfer device, an endless photoreceptor belt having an imageable surface for forming said toner image, and a conicity reducing belt support and moving subassembly for supporting and moving said endless photoreceptor belt, said endless photoreceptor belt forming a first wrap angle about a tensioning roll, and a second wrap angle of greater than 90 degrees about a moveable steering roll, and said conicity reducing belt support and moving subassembly including (i) said moveable steering roll moving in a first direction into said endless photoreceptor belt and in a second direction along an inner surface of said endless photoreceptor belt, said second direction of movement of said steering roll being normal to a bisectrix of said second wrap angle about said steering roll, and including a first free hard axis, and (ii) said moveable tensioning roll moving in a third direction into said endless photoreceptor belt and in a fourth direction along the inner surface of said endless photoreceptor belt, thereby reducing belt conicity and belt wrinkle, and increasing belt lateral registration.

2. The electrostatographic reproduction machine according to claim 1, wherein said moveable steering roll exerts a belt tensioning force on said endless photoreceptor belt when moved in said first direction.

3. The electrostatographic reproduction machine according to claim 1, wherein said moveable tensioning roll exerts a belt tensioning force on said endless photoreceptor belt when moved in said third direction.

4. The electrostatographic reproduction machine according to claim 1, wherein said fourth direction of movement of said tensioning roll comprises a second free hard axis and is normal to a bisectrix of said first wrap angle about said tensioning roll.

5. The electrostatographic reproduction machine according to claim 1, including a pivot shaft connected to said steering roll and having a pivot axis for moving said steering roll pivotably in said second direction.

6. The electrostatographic reproduction machine according to claim 5, wherein said pivot axis forms an angle with a bisectrix of said second wrap angle about said steering roll.

7. The electrostatographic reproduction machine according to claim 5, wherein a belt tensioning force, exerted on said steering roll in a direction of the bisectrix of said second wrap angle, has a side component for biasing said pivot shaft.

* * * * *